US009728890B2

(12) United States Patent
Nakai et al.

(10) Patent No.: US 9,728,890 B2
(45) Date of Patent: Aug. 8, 2017

(54) ELECTRIC WIRE HOLDER HAVING A HOLE WITH AN INTERNAL DIAMETER SMALLER THAN AN EXTERNAL DIAMETER OF AN ACCOMMODATED ELECTRIC WIRE

(71) Applicant: YAZAKI CORPORATION, Minato-ku, Toyko (JP)

(72) Inventors: Satoshi Nakai, Kakegawa (JP); Toru Suzuki, Kakegawa (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 14/899,921

(22) PCT Filed: Jun. 19, 2014

(86) PCT No.: PCT/JP2014/066242
§ 371 (c)(1),
(2) Date: Dec. 18, 2015

(87) PCT Pub. No.: WO2014/203954
PCT Pub. Date: Dec. 24, 2014

(65) Prior Publication Data

US 2016/0141796 A1 May 19, 2016

(30) Foreign Application Priority Data

Jun. 21, 2013 (JP) ..... 2013-130299

(51) Int. Cl.
*H01R 13/52* (2006.01)
*H01R 13/58* (2006.01)

(52) U.S. Cl.
CPC ..... *H01R 13/5816* (2013.01); *H01R 13/52* (2013.01); *H01R 13/5202* (2013.01);
(Continued)

(58) Field of Classification Search
CPC H01R 13/52; H01R 13/5202; H01R 13/5205; H01R 13/5812; H01R 13/5829; H01R 13/5833; H01R 13/58
(Continued)

(56) References Cited

U.S. PATENT DOCUMENTS 5,675,124 A * 10/1997 Stough ..... H02G 15/013 174/656
6,071,147 A * 6/2000 Tsukamoto ..... H01R 13/5208 439/275

(Continued)

FOREIGN PATENT DOCUMENTS

JP 60-195885 A 10/1985
JP 05-031146 U 4/1993

(Continued)

OTHER PUBLICATIONS

International Search Report for PCT/JP2014/066242 dated Jul. 29, 2014 [PCT/ISA/210].

(Continued)

*Primary Examiner* — Chandrika Prasad
(74) *Attorney, Agent, or Firm* — Sughrue Mion, PLLC

(57) ABSTRACT

The connector is provided with a connector housing (3) having a holder accommodating chamber (31*c*), and a rear holder (32A), with an electric wire (21) inserted into an electric wire insertion hole (39) thereof, accommodated within the holder accommodating chamber (31*c*). The external diameter dimension (D1) of the electric wire (21) is larger than the internal diameter dimension (D2) of the electric wire insertion hole (39) of the rear holder (32A), and the internal diameter dimension (D4) of the holder accommodating chamber (31*c*) of the connector housing (3) is smaller than the external diameter dimension (D3) of the
(Continued)

rear holder (32A) with the electric wire (21) accommodated within the electric wire insertion hole (39).

5 Claims, 16 Drawing Sheets

(52) U.S. Cl.
CPC ..... *H01R 13/58* (2013.01); *H01R 13/5812* (2013.01); *H01R 13/5833* (2013.01)

(58) Field of Classification Search
USPC ..... 439/271–275, 459
See application file for complete search history.

(56) References Cited

U.S. PATENT DOCUMENTS 6,331,124 B1 * 12/2001 Miyazaki ..... H01R 13/5208 439/587
6,494,731 B1 * 12/2002 Suzuki ..... H01R 13/5208 439/275
7,033,215 B2 * 4/2006 Kobayashi ..... H01R 13/5205 439/587
7,699,653 B2 * 4/2010 Sakamoto ..... H01R 13/5221 174/50
2004/0229508 A1 * 11/2004 Miyazaki ..... H01R 9/0521 439/607.01
2008/0139028 A1 * 6/2008 Burris ..... H01R 13/5219 439/271
2011/0207354 A1 * 8/2011 Tashiro ..... H01R 13/5208 439/271
2014/0008122 A1 * 1/2014 Imahori ..... H01B 17/308 174/77 R
2015/0140848 A1 * 5/2015 Sato ..... H01R 13/5202 439/271
2015/0140850 A1 * 5/2015 Suzuki ..... H01R 9/0524 439/275

FOREIGN PATENT DOCUMENTS

JP 06-038174 U 5/1994
JP 10-050412 A 2/1998
JP 2001-060475 A 3/2001
JP 2010-118328 A 5/2010

OTHER PUBLICATIONS

Written Opinion for PCT/JP2014/066242 dated Jul. 29, 2014 [PCT/ISA/237].
Communication dated Oct. 4, 2016 from the Japanese Patent Office in counterpart Application No. 2013-130299.
Communication dated Feb. 21, 2017, from the Japanese Patent Office in counterpart Japanese application No. 2013-130299.

* cited by examiner

ELECTRIC WIRE HOLDER HAVING A HOLE WITH AN INTERNAL DIAMETER SMALLER THAN AN EXTERNAL DIAMETER OF AN ACCOMMODATED ELECTRIC WIRE

TECHNICAL FIELD

The present invention relates to a connector having an electric wire holder for holding an electric wire in a connector housing.

BACKGROUND ART

A connector having an electric wire holder for holding an electric wire in a connector housing has been suggested in the past. A first conventional example of such a connector is shown in FIG. 1, FIG. 2A, and FIG. 2B. In FIG. 1, FIG. 2A and FIG. 2B, a connector 100 includes a connector housing 102 accommodating a terminal 101 and a shield shell 102A arranged to enclose a portion of an external periphery of the connector housing 102. The connector housing 102 is provided with a cylindrical portion 103 protruding to the rear from the cylinder of the shield shell 102A. The rear end of the cylindrical portion 103 is attached with a rear holder (electric wire holder) 104. A protrusion 105 extending in an external diameter direction is provided on the distal end external periphery of the cylindrical portion 103. The rear holder 104 has an arm 107 extending to the front from a main body portion 106, and a lock portion 108 with which the protrusion 105 is locked is arranged at the distal end of this arm 107.

In the above configuration, the rear holder 104 is inserted from the rear end of the cylindrical portion 103 of the connector housing 102, and the protrusion 105 of the distal end external periphery of the cylindrical portion 103 is locked with the lock portion 108 arranged at the distal end of the arm 107 of the rear holder 104. Accordingly, the rear holder 104 is fixed to the connector housing 102. Since the electric wire is held by the rear holder 104, this can prevent the electric wire from being pulled out of the connector housing 102, and can prevent a pull-out force from being applied to the distal end side of the electric wire (for example, a terminal).

A second conventional example of this kind of connector is shown in FIG. 3 (refer to Patent Literature 1). In FIG. 3, the connector 110 includes a connector housing 112 for accommodating a terminal 111. An accommodating chamber 113 at a rear end of this connector housing 112 accommodates a retainer (electric wire holder) 114. At the front end side with respect to the retainer 114, a rubber plug 115 is provided to seal between the connector housing 112 and the electric wire W is provided. At the external periphery of the retainer 114, a protrusion 117 is provided that extends in the external diameter direction of the retainer 114 and is locked in a locking hole 116 arranged in the connector housing 112.

In the above configuration, the terminal 111 is accommodated in the connector housing 112, and the electric wire W connected to this terminal 111 is inserted into the retainer 114, and the retainer 114 is accommodated in the accommodating chamber 113 of the connector housing 112, and the protrusion 117 of the external periphery of the retainer 114 is locked with the locking hole 116 of the connector housing 112, so that the retainer 114 is fixed to the connector housing 112. Accordingly, the retainer 114 holds the electric wire W, and therefore, this can prevent the electric wire W from being pulled out of the connector housing 112, and can prevent the pull-out force from being applied to the distal end side of the electric wire W.

CITATION LIST

Patent Literature

Patent Literature 1: JP 2001-60475 A

SUMMARY OF INVENTION

Technical Problem

In the connector 100 according to the first conventional example, the protrusion 105 of the connector housing 102 and the lock portion 108 of the rear holder 104 are designed in view of the assembly tolerance, and therefore, a backlash may occur due to an assembly tolerance between the connector housing 102 and the rear holder 104. When there is a backlash between the connector housing 102 and the rear holder 104, there is a problem in that the rear holder 104 cannot shut off vibration from the electric wire.

In addition, in the connector 110 according to the second conventional example, the internal diameter of the accommodating chamber 113 of the connector housing 112 and the external diameter of the retainer 114 are designed in view of an assembly tolerance, and therefore, a backlash may occur due to an assembly tolerance. When there is a backlash between the connector housing 112 and the retainer 114, there is a problem like the above problem in that the retainer 114 cannot shut off vibration from the electric wire.

Accordingly, the present invention is made to solve the above problems, and it is an object of the present invention to provide a connector that can suppress backlash between a connector housing and an electric wire holder and in which the electric wire holder can shut off vibration from the electric wire.

Solution to Problem

A connector according to the present invention includes a connector housing provided with a holder accommodating chamber, and an electric wire holder including an electric wire insertion hole and configured to insert an electric wire into the electric wire insertion hole and to be accommodated within the holder accommodating chamber. An external diameter dimension of the electric wire is configured to be larger than an internal diameter dimension of the electric wire insertion hole of the electric wire holder, and an internal diameter dimension of the holder accommodating chamber of the connector housing is configured to be less than an external diameter dimension of the electric wire holder in a state where the electric wire is accommodated in the electric wire insertion hole.

The electric wire holder of the connector according to the present invention may include two divided bodies each provided with an electric wire groove, and the electric wire insertion hole is formed by the two electric wire grooves.

The two divided bodies of the connector according to the present invention may have a coupling portion for coupling with each other.

Advantageous Effects of Invention

According to the present invention, the electric wires are inserted into the electric wire insertion holes of the electric wire holder, and the electric wire holder is accommodated in the holder accommodating chamber of the connector housing, the external diameter dimension of the electric wire is more than the internal diameter dimension of the electric wire insertion hole of the electric wire holder, and the interference of the electric wire of the electric wire holder is exerted, and the external diameter dimension of the electric wire holder increases because of the elastic counterforce of this electric wire, and this eliminates the gap between the electric wire holder and the holder accommodating chamber of the connector housing, and the electric wire holder is pressed against the connector housing. Therefore, backlash between the electric wire and the electric wire holder and in addition is eliminated, backlash between the connector housing and the electric wire holder is eliminated. Therefore, the electric wire holder can cut off the vibration from the electric wire.

DESCRIPTION OF EMBODIMENTS

An embodiment of the present invention is described in detail with reference to drawings.

In this specification, it must be noted that drawings are schematic views, and constitutions of devices and systems are different from constitutions of an actual device. Accordingly, the specific constitutions should be determined by taking into account the description made hereinafter. Further, it is also needless to say that the respective drawings include portions having different constitutions.

The embodiment of the present invention described hereinafter is provided for exemplifying a device and a method which embody the technical concept of the present invention, and the technical concept of the present invention does not limit materials, shapes, structures, arrangements and the like of the respective constitutional parts to the followings. Various modifications are conceivable with respect to the technical concept of the present invention within the technical scope described in claims.

First Embodiment

Figure 10:
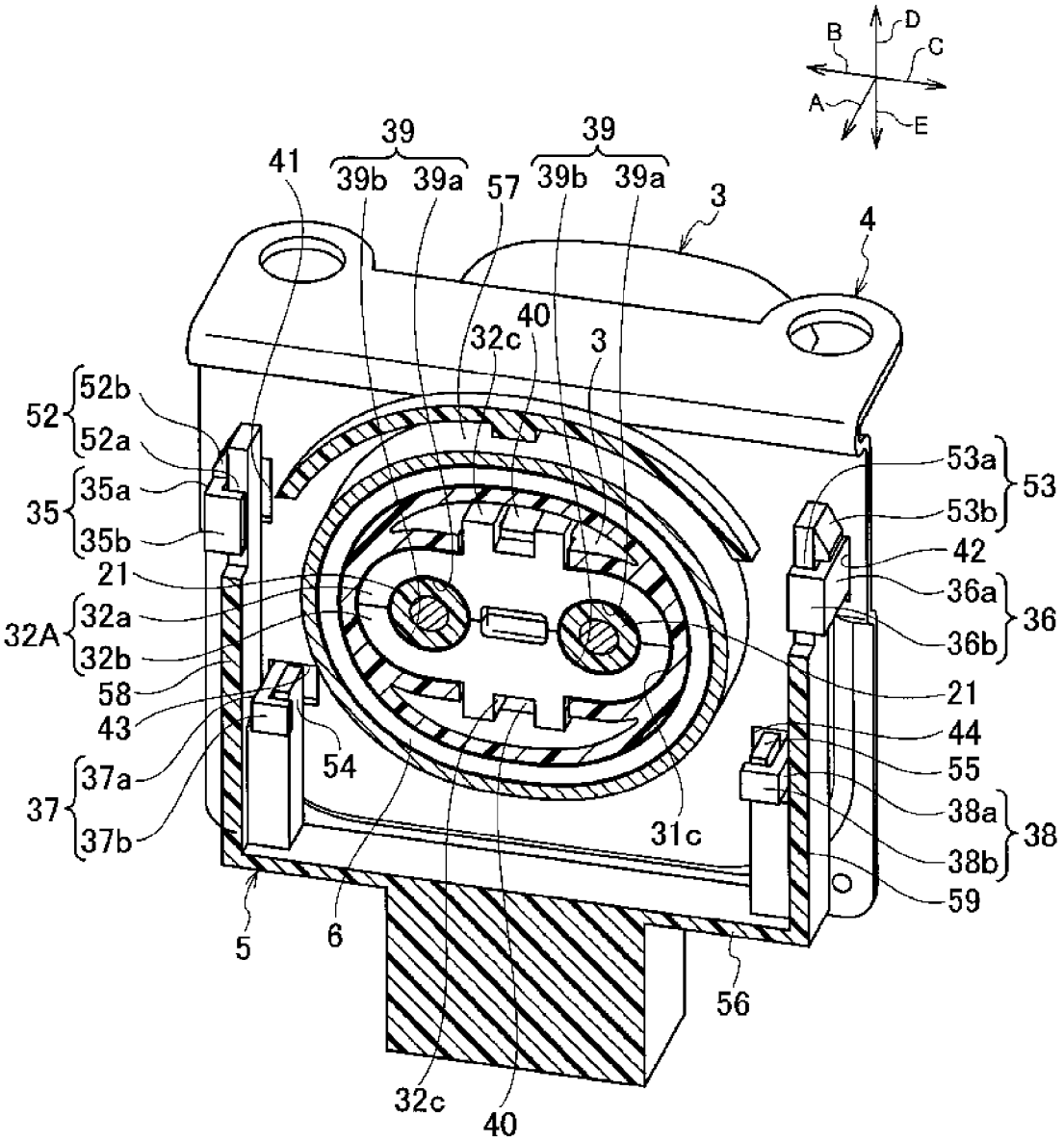
FIG. 10 illustrates the first embodiment according to the present invention, and is a partially cutaway perspective diagram for explaining a structure such as the lock portion.
Figure 11A:
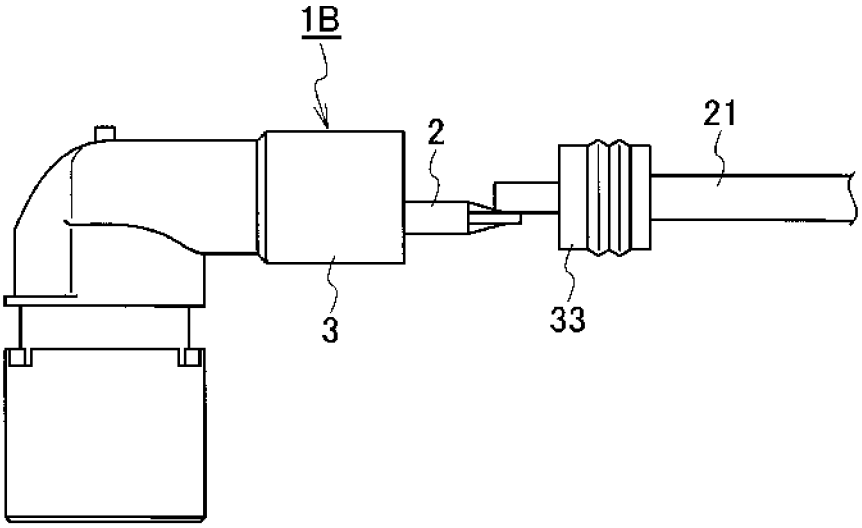
FIG. 11A illustrates a second embodiment according to the present invention, and is a side view illustrating an assembly procedure of a rear holder to a connector.
Figure 11B:
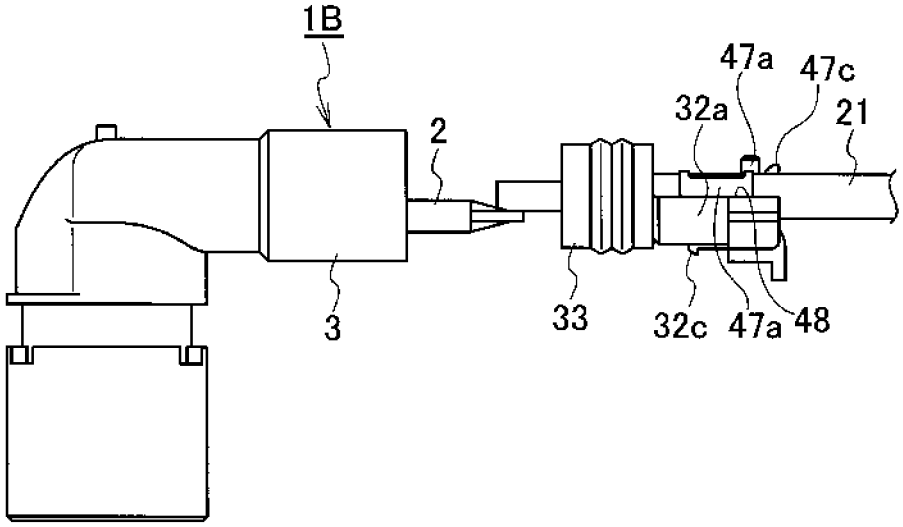
FIG. 11B illustrates the second embodiment according to the present invention, and is a side view illustrating an assembly procedure of the rear holder to the connector.
Figure 11C:
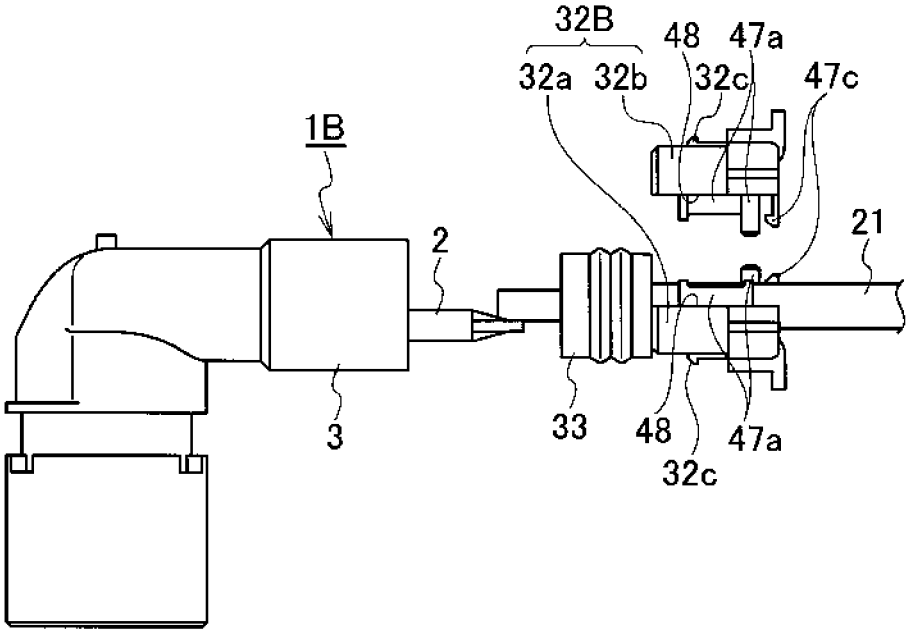
FIG. 11C illustrates the second embodiment according to the present invention, and is a side view illustrating an assembly procedure of the rear holder to the connector.
Figure 12A:
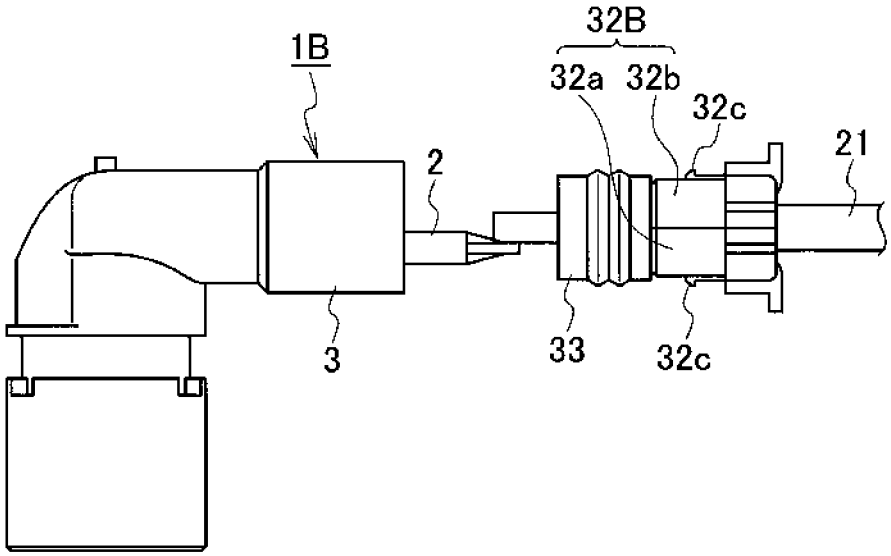
FIG. 12A illustrates the second embodiment according to the present invention, and is a side view illustrating an assembly procedure of the rear holder to the connector.
Figure 12B:
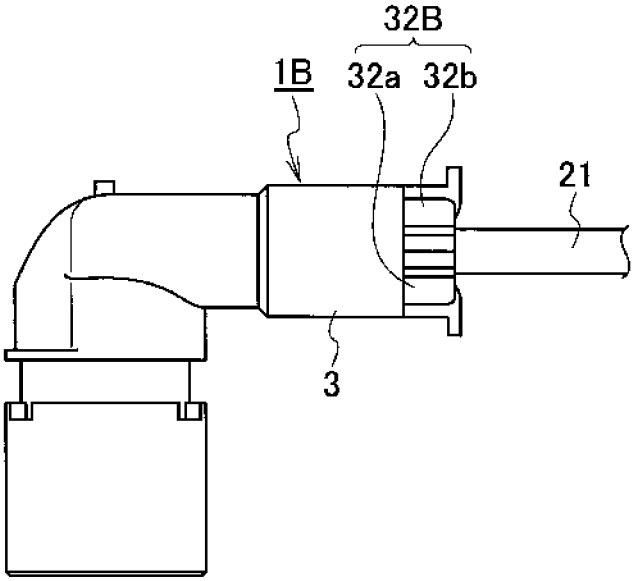
FIG. 12B illustrates the second embodiment according to the present invention, and is a side view illustrating a state in which the rear holder is assembled with the connector.

FIG. 4 to FIG. 10 illustrate a first embodiment of the present invention. A connector 1A according to this first embodiment is a high voltage female connector-type shield connector connected to an inverter case (not shown). The connector 1A is attached to an inverter by being mated to a terminal block (not shown) provided inside of the inverter. It should be noted that FIG. 10 is a perspective diagram corresponding to FIG. 9 (longitudinal sectional view), and in FIG. 10, a connector housing 3, a shield shell 4, a protector 5, and the like are partially cut away in order to explain a structure of lock portions 35 to 38, 52 to 55 in an easy to understand manner.

Figure 1:
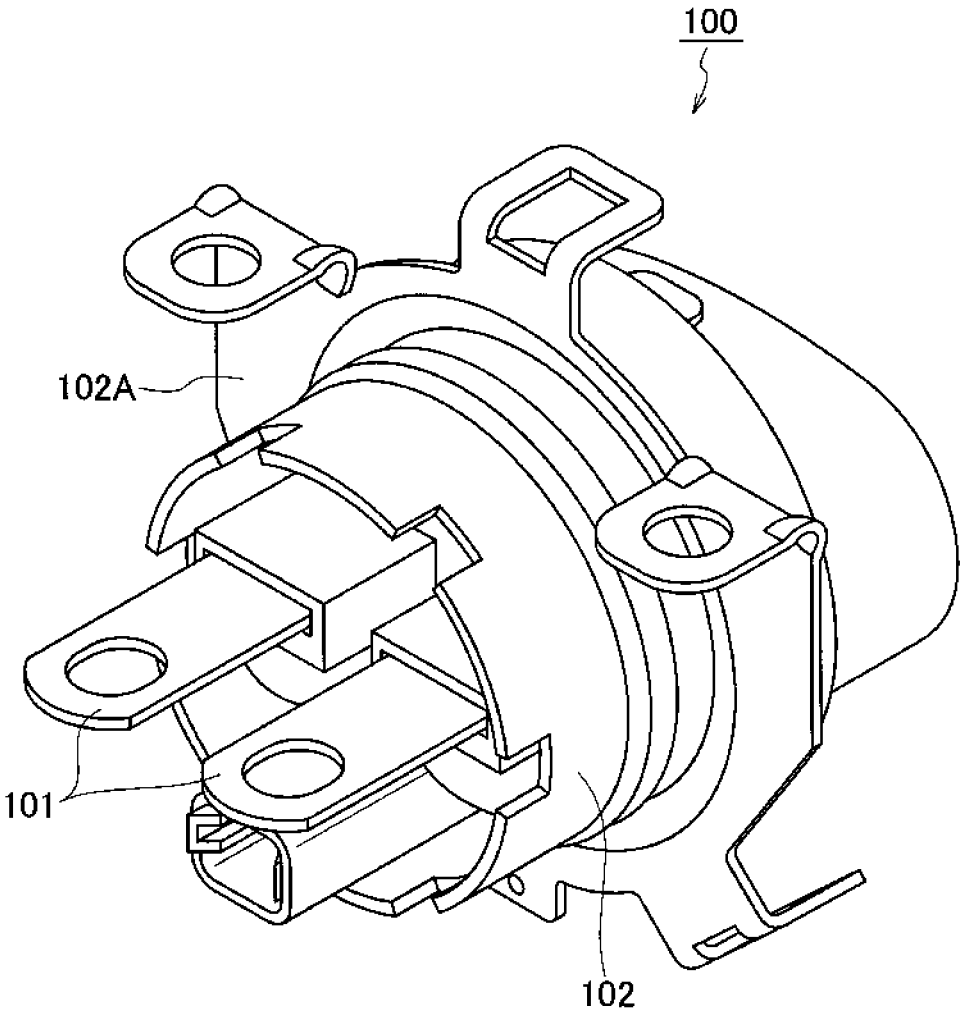
FIG. 1 illustrates a first conventional example, and is an assembly perspective view of a connector.
Figure 2A:
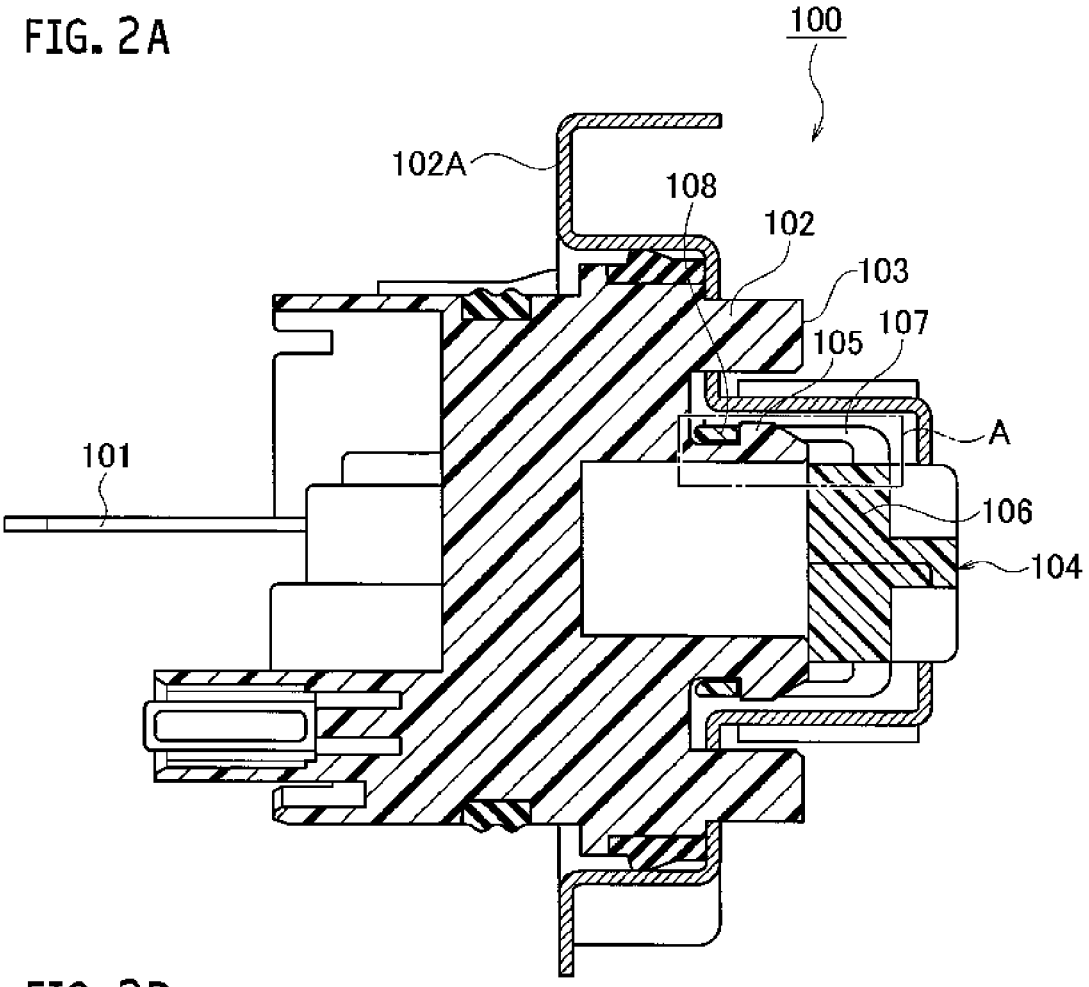
FIG. 2A illustrates the first conventional example, and is a longitudinal sectional view of the connector.
Figure 2B:
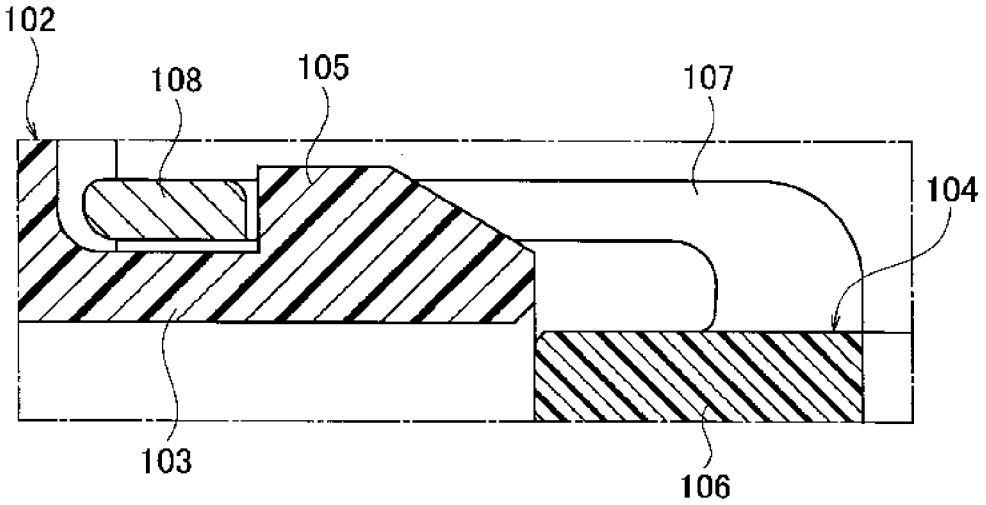
FIG. 2B illustrates the first conventional example, and is an enlarged sectional view of a section A in FIG. 2A.
Figure 3:
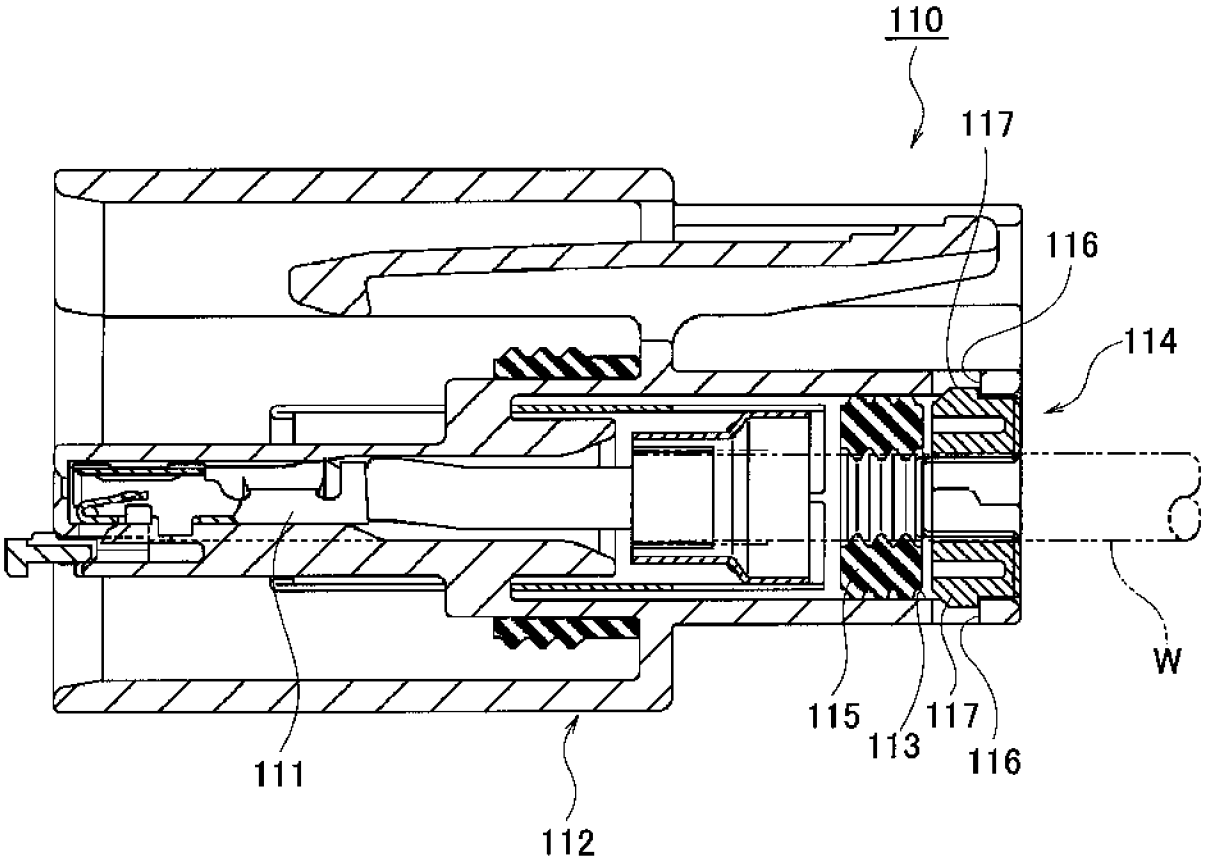
FIG. 3 illustrates a second conventional example, and is a longitudinal sectional view of a connector.
Figure 4:
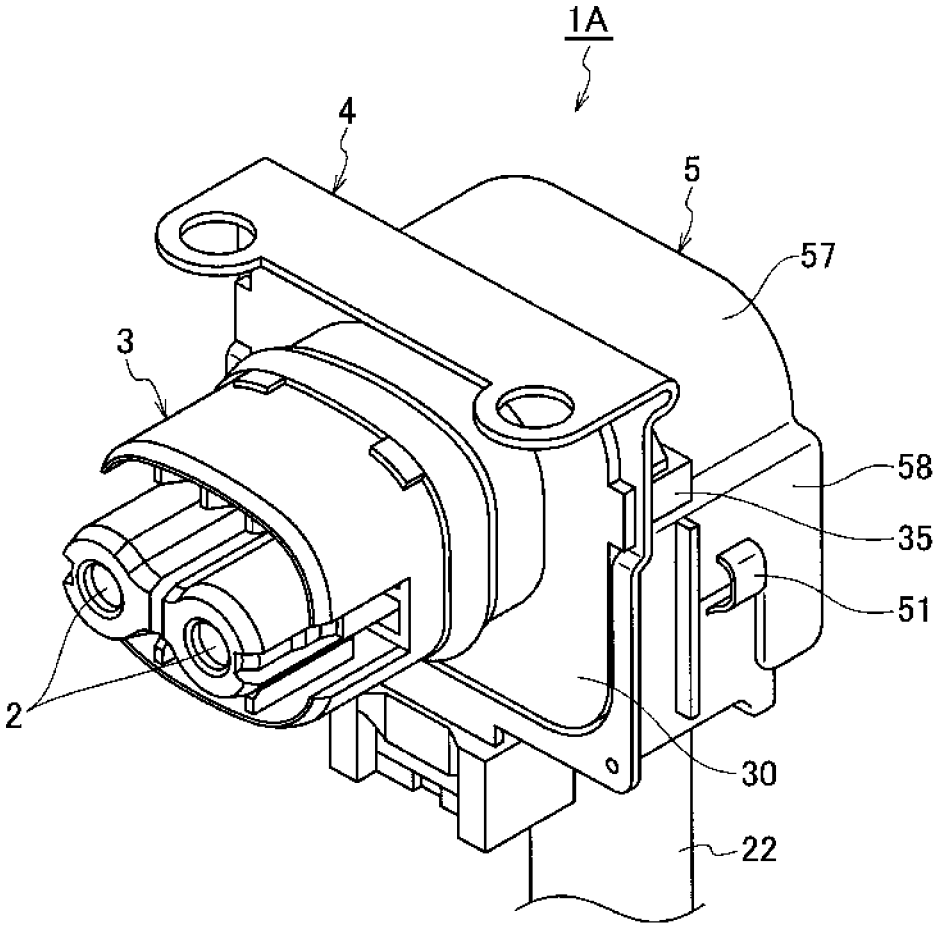
FIG. 4 illustrates a first embodiment according to the present invention, and is an assembly perspective view of a connector.
Figure 5:
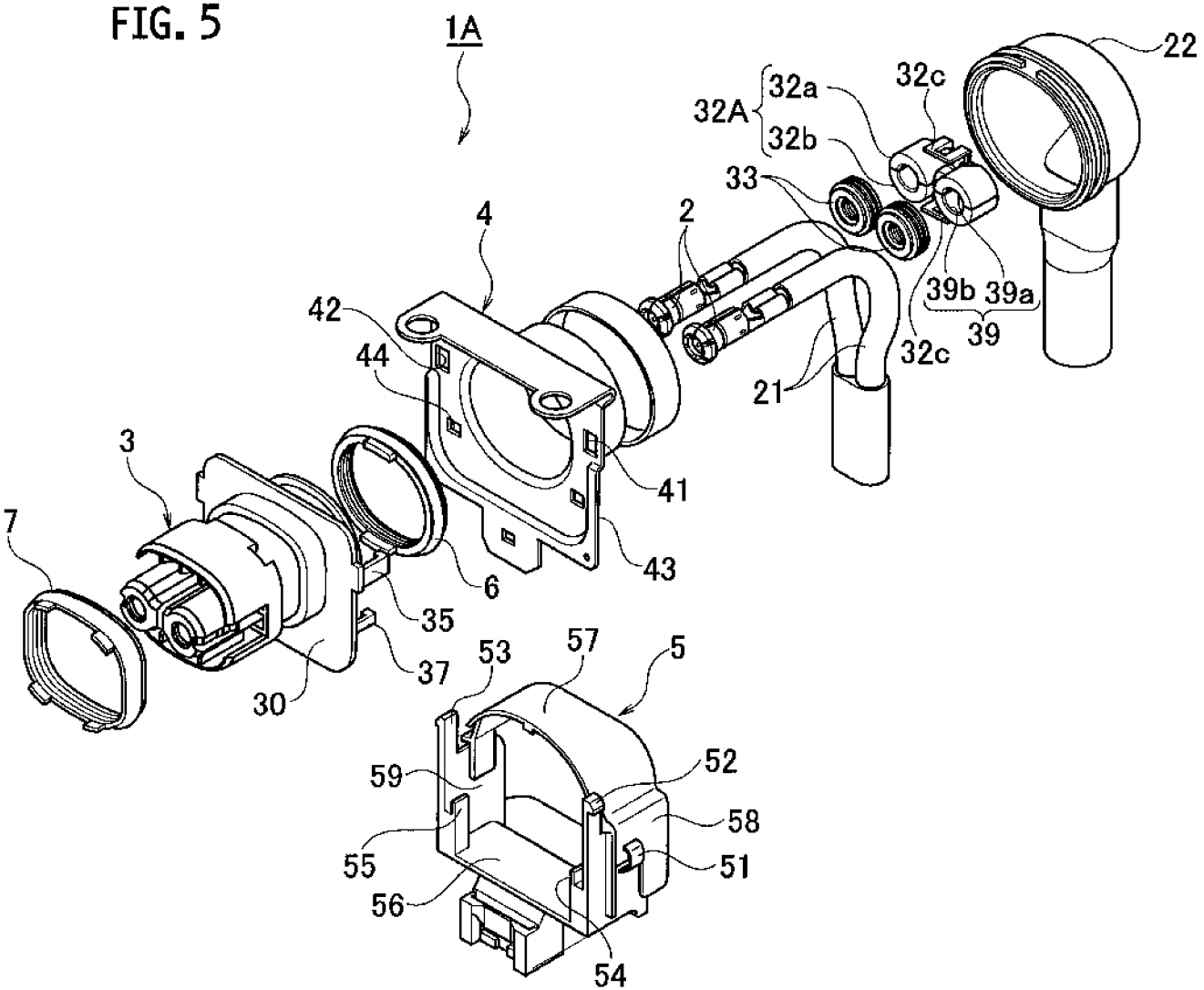
FIG. 5 illustrates the first embodiment according to the present invention, and is an exploded perspective diagram of the connector.
Figure 6:
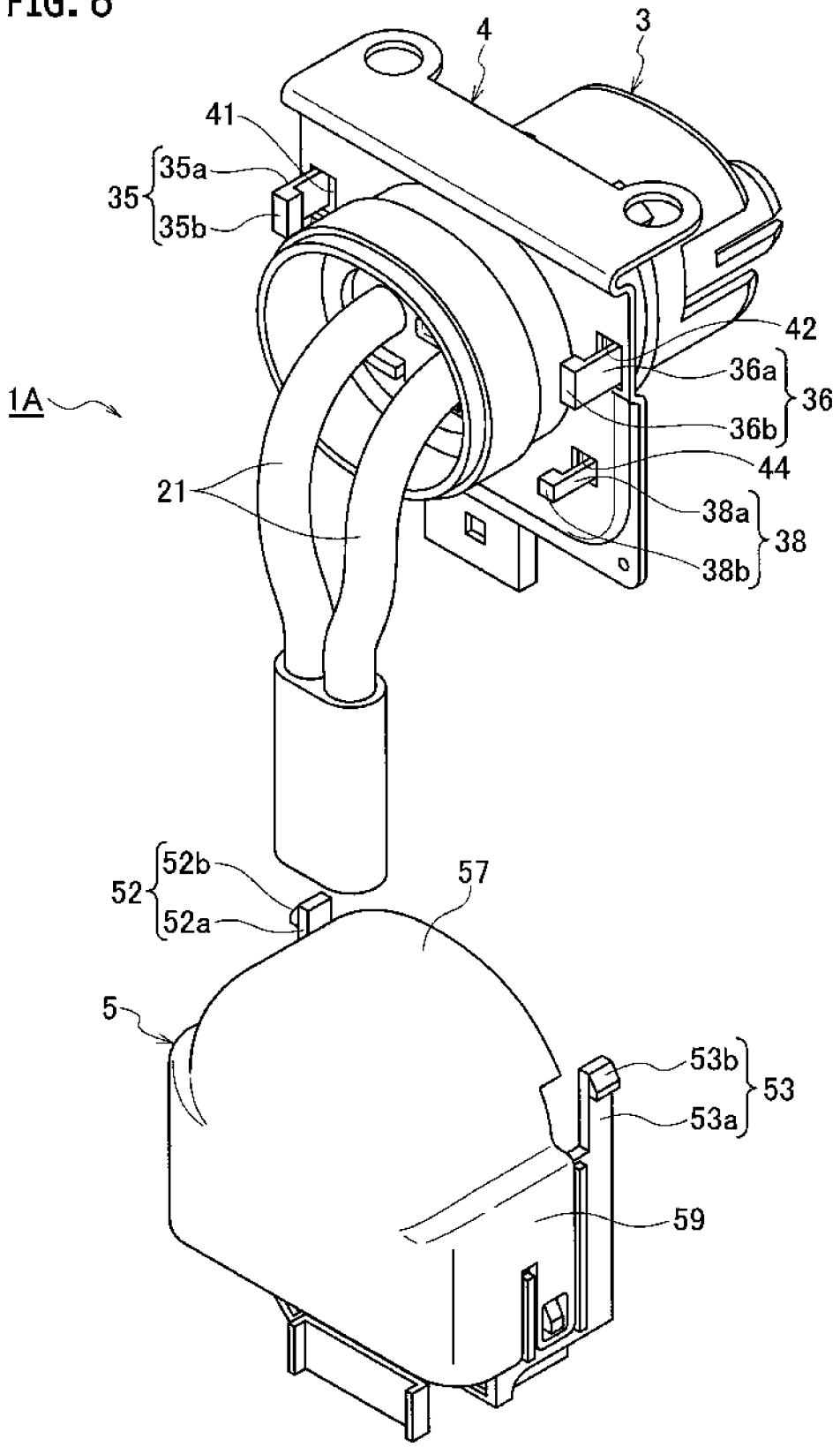
FIG. 6 illustrates the first embodiment according to the present invention, and is a perspective diagram illustrating a process of assembly of the connector when the connector is seen from the back surface side.
Figure 7:
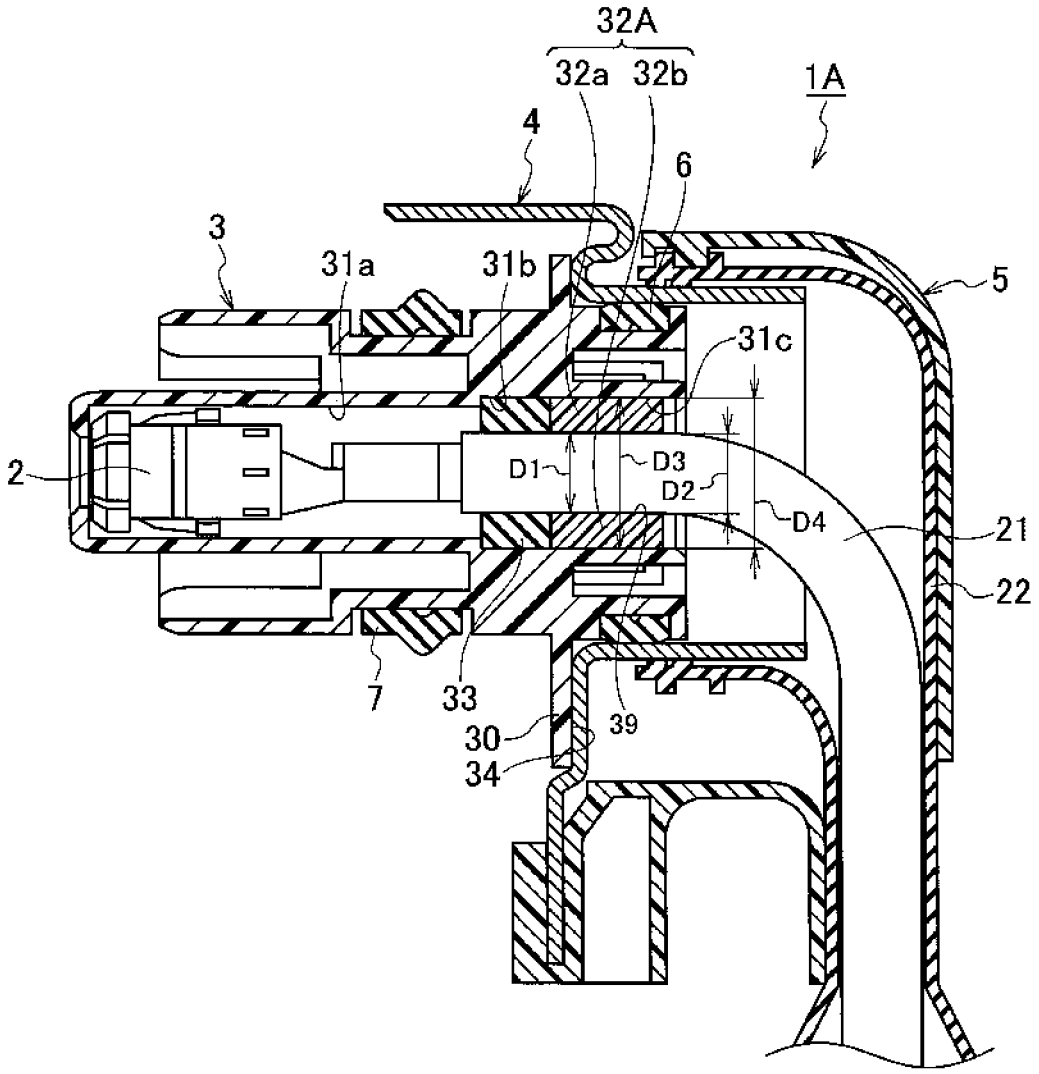
FIG. 7 illustrates the first embodiment according to the present invention, and is a longitudinal sectional view of the connector.
Figure 8:
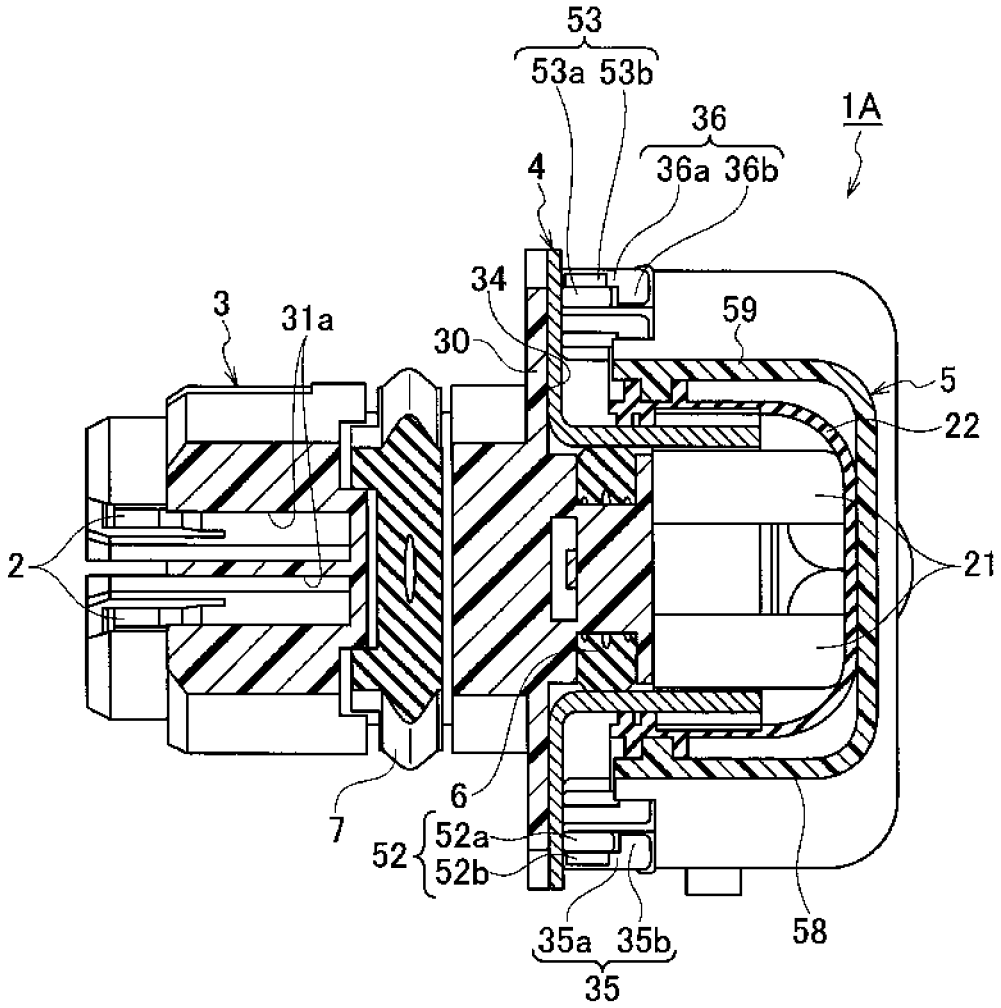
FIG. 8 illustrates the first embodiment according to the present invention, and is a transverse sectional view of the connector.
Figure 9:
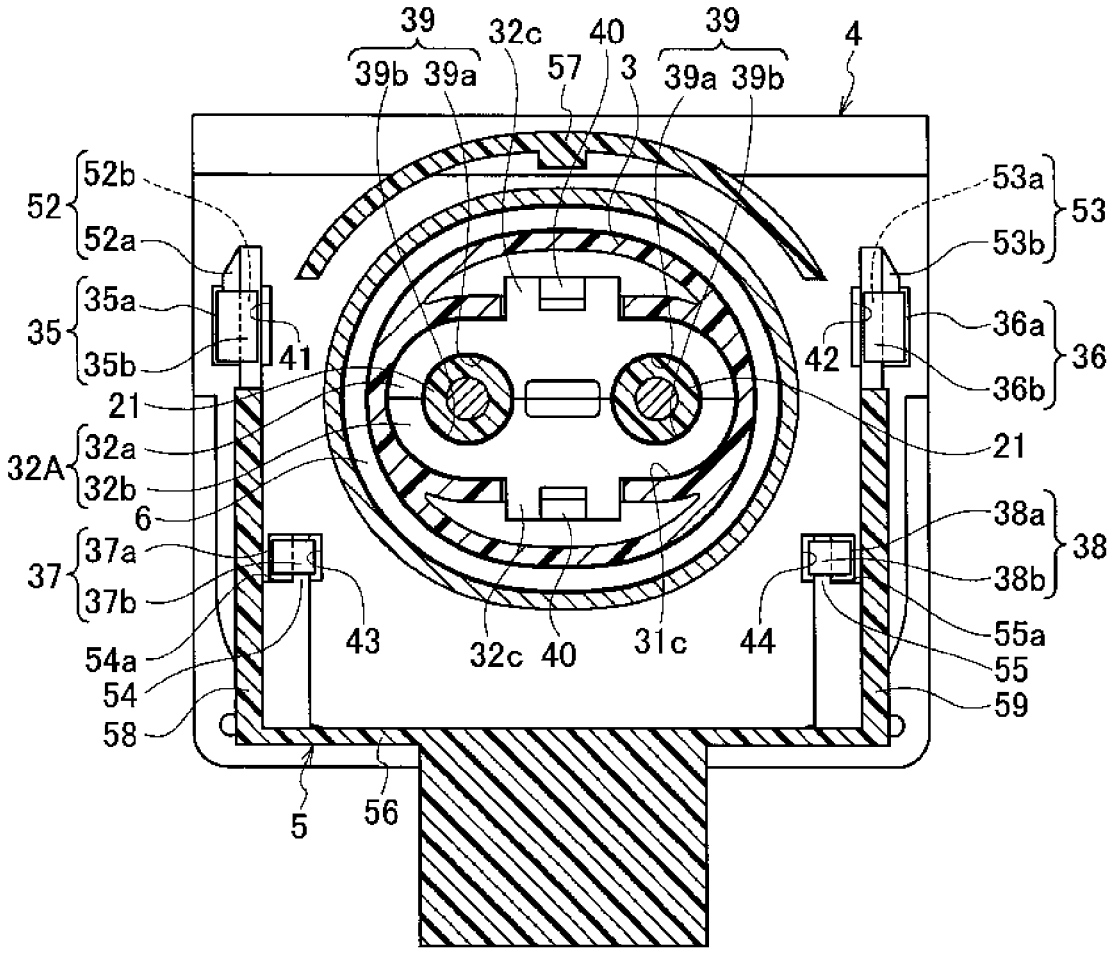
FIG. 9 illustrates the first embodiment according to the present invention, and is a longitudinal sectional view for explaining a structure such as a lock portion.

As shown in FIG. 4 and FIG. 5, the connector 1A includes the substantially cylindrical shape connector housing 3 accommodating a pair of right and left terminals 2, the shield shell 4 arranged on an external periphery of this connector housing 3, and the protector 5 arranged to cover the back of the connector housing 3. A shell packing (shell packing) 6 seals a space between the external peripheral surface of the connector housing 3 and the inner peripheral of the shield shell 4, and a unit packing (unit packing) 7 is arranged on the external periphery of the connector housing 3.

Electric wires 21 are connected to the pair of terminals 2. This electric wire 21 extends from the inside of the connector housing 3 in an electric wire draw-out direction (a direction indicated by arrow A in FIG. 10), and the electric wire 21 bends to the lower side in the course, and is covered with a rubber boot 22. Further, this rubber boot 22 is covered with the protector 5.

The connector housing 3 is provided with a flange portion 30 extending in a direction perpendicular to an electric wire draw-out direction, terminal accommodating chambers 31*a* accommodating the terminals 2, and electric wire draw-out holes 31*b* in communication with the terminal accommodating chambers 31*a*. A part of the electric wire draw-out hole 31*b* is formed as a holder accommodating chamber 31*c*. The rear holder (electric wire holder) 32A for holding the electric wire 21 is accommodated in the holder accommodating chamber 31*c*. A rubber plug 33 for sealing the space between the connector housing 3 and the electric wire 21 is accommodated at the forward position with respect to the holder accommodating chamber 31*c*.

The rear holder 32A is configured of two divided bodies 32*a*, 32*b* assembled with each other. Each of the divided bodies 32*a*, 32*b* has an elastic arm locking portion 32*c*. When the rear holder 32A is inserted to an appropriate position of the holder accommodating chamber 31*c*, each elastic arm locking portion 32*c* is locked with a locked projection portion 40 of the connector housing 3. In this case, the elastic arm locking portion 32*c* and the locked projection portion 40 are designed in view of the assembly tolerance.

Each of the two divided bodies 32*a*, 32*b* has a pair of semicircular electric wire grooves 39*a*, 39*b*. In the state where the two divided bodies 32*a*, 32*b* are assembled, the rear holder 32A has two sets of electric wire insertion holes 39 each configured of the pair of electric wire grooves 39*a*, 39*b*.

An external diameter dimension D1 of the electric wire 21 is configured to be larger than an internal diameter dimension D2 of each electric wire insertion hole 39 (the external diameter dimension D1 of the electric wire 21>the internal diameter dimension D2 of each electric wire insertion hole 39). An internal diameter dimension D4 of the holder accommodating chamber 31*c* of the connector housing 3 is configured to be larger than an external diameter dimension D3 of the rear holder 32A as a component alone (the external diameter dimension D3 of the rear holder 32A as the component alone<the internal diameter dimension D4 of the holder accommodating chamber 31*c* of the connector housing 3).

Further, the interference of the electric wire 21 with the rear holder 32A is configured to be the same as or larger than the gap between the connector housing 3 and the rear holder 32A (the external diameter dimension D1 of the electric wire 21−the internal diameter dimension D2 of each electric wire insertion hole 39≥the internal diameter dimension D4 of the holder accommodating chamber 31*c* of the connector housing 3−the external diameter dimension D3 of the rear holder 32A as a component alone). As explained below, in the state where the electric wire 21 is accommodated in the electric wire insertion hole 39, the rear holder 32A is pressurized by the interference of the electric wire 21 with the rear holder 32A, and the diameter of the rear holder 32A is expanded, and accordingly, the external diameter dimension D3 of the rear holder 32A increases.

A pair of right and left housing-side lock portions 35, 36 arranged above side plate parts 58, 59, explained later, of the protector 5 are provided on a surface 34 of the flange portion 30 located at the rear end side of the connector housing 3. Each of the housing-side lock portions 35, 36 includes locked portions 35*a*, 36*a* protruding from the surface 34 of the flange portion 30 and extending in the electric wire draw-out direction and stopper portions 35*b*, 36*b* that prevent the protector-side lock portions 52, 53 locked with the locked portions 35*a*, 36*a* from displacing in the electric wire draw-out direction.

The connector housing 3 is provided with the pair of right and left housing-side lock portions 35, 36 as well as pair of right and left housing-side auxiliary lock portions 37, 38 arranged inside of the side plate parts 58, 59 of the protector 5. Each of the housing-side auxiliary lock portions 37, 38 includes position restriction portions 37*a*, 38*a* protruding from the surface 34 of the flange portion 30 and extending in the electric wire draw-out direction and auxiliary lock-side stopper portions 37*b*, 38*b* that prevent the protector-side auxiliary lock portions 54, 55, explained later, from displacing in the electric wire draw-out direction.

The shield shell 4 is provided with lock portion insertion holes 41, 42 into which the housing-side lock portions 35, 36, respectively, are inserted, and is provided with auxiliary lock portion insertion holes 43, 44 into which the housing-side auxiliary lock portions 37, 38, respectively, are inserted.

The protector 5 includes a flat plate shaped bottom plate part 56, a top plate part 57 bent at the upper side, and a pair of right and left side plate parts 58, 59 arranged vertically at the right and left end portions of the bottom plate part 56 and the top plate part 57, and is formed to be able to open and close vertically via a hinge 51 arranged on one of the side plate parts 58.

A pair of right and left protector-side lock portions 52, 53 locked with the housing-side lock portions 35, 36, respectively, is arranged above the side plate parts 58, 59 of the protector 5. These protector-side lock portions 52, 53 include arm parts 52*a*, 53*a*, respectively, protruding to the upper side with respect to the side plate parts 58, 59, respectively, and deforming in a direction perpendicular to the electric wire draw-out direction (a direction indicated by arrows B, C of FIG. 10) and locking claw parts 52*b*, 53*b* arranged at the distal end side of the arm parts 52*a*, 53*a*, respectively.

In addition, the protector 5 is provided with the pair of right and left protector-side lock portions 52, 53, respectively, and the pair of right and left protector-side auxiliary lock portions 54, 55, respectively. The protector-side auxiliary lock portions 54, 55 are arranged inside of the side plate parts 58, 59 of the protector 5. Upper stopper step surfaces 54*a*, 55*a* are arranged above the protector-side auxiliary lock portions 54, 55, respectively, and when the protector 5 is assembled, the position restriction portions 37*a*, 38*a* come into contact with the upper stopper step surfaces 54*a*, 55*a*, respectively, so that the protector 5 is positioned.

In the above configuration, when the connector 1A is assembled, the shell packing 6 and the shield shell 4 are attached to the connector housing 3, and the terminal 2, the electric wire 21, and the rear holder 32A are assembled into the connector housing 3. At this occasion, the electric wires 21 are inserted into the electric wire grooves 39*a*, 39*b* of the divided bodies 32*a*, 32*b*, and the divided bodies 32*a*, 32*b* are combined with each other, so that the rear holder 32A is integrated and accommodated in the electric wire draw-out hole 31*b*.

As a result, since the external diameter dimension D1 of the electric wire 21 is more than the internal diameter dimension D2 of the electric wire insertion hole 39 of the rear holder 32A, the interference of the electric wire 21 of the rear holder 32A is exerted, and the diameter of the rear holder 32A is expanded due to the elastic counterforce from the electric wire 21, and accordingly, the external diameter dimension D3 of the rear holder 32A increases, which eliminates the gap between the rear holder 32A and the holder accommodating chamber 31*c* of the connector housing 3. Therefore, the rear holder 32A is pressed against the connector housing 3 by the elastic counterforce of the electric wire 21, and this can suppress the backlash between the connector housing 3 and the rear holder 32A, and the rear holder 32A can shut off vibration from the electric wire 21.

In addition, the backlash between the electric wire 21 and the rear holder 32A can be suppressed.

Subsequently, the rubber boot 22 is attached to cover the electric wires 21 drawn out from the connector housing 3, and the protector 5 is assembled with the connector housing 3 in a direction perpendicular to the electric wire draw-out direction (a direction indicated by arrow D of FIG. 10). Accordingly, the portion of the shield shell 4 that comes into contact with the surface 34 of the flange portion 30 of the connector housing 3 is sandwiched by the protector 5 and the flange portion 30 of the connector housing 3, and in this state, the housing-side lock portions 35, 36 and the protector-side lock portions 52, 53 are locked with each other, and therefore, the shield shell 4 is fixed to the connector housing 3 via the protector 5.

When the protector 5 is assembled with the connector housing 3 in a direction perpendicular to the electric wire draw-out direction as described above, the pair of protector-side lock portions 52, 53 are locked such that the arm parts 52*a*, 53*a* are deformed in directions opposite to each other, i.e., directions indicated by arrows B, C of FIG. 10, and the locking claw parts 52*b*, 53*b* are locked with the locked portions 35*a*, 36*a*. At the same time, a pair of protector-side auxiliary lock portions 54, 55 are locked with the position restriction portions 37*a*, 38*a* and the auxiliary lock-side stopper portions 37*b*, 38*b* of the housing-side auxiliary lock portions 37, 38, respectively.

As described above, according to the present embodiment, when the electric wires 21 are inserted into the electric wire insertion holes 39 of the rear holder 32A, and the rear holder 32A is accommodated in the holder accommodating chamber 31*c* of the connector housing 3, the interference of the electric wire 21 of the rear holder 32A is exerted, and this eliminates the gap between the rear holder 32A and the holder accommodating chamber 31*c* of the connector housing 3, and the rear holder 32A is pressed against the connector housing 3, and therefore, backlash between the electric wire 21 and the rear holder 32A is eliminated, and in addition, backlash between the connector housing 3 and the rear holder 32A is eliminated. Therefore, the rear holder 32A can cut off vibration from the electric wire 21.

According to the present embodiment, the electric wires 21 are inserted into the electric wire grooves 39*a*, 39*b* of the divided bodies 32*a*, 32*b* while the rear holder 32A is divided, and the divided bodies 32*a*, 32*b* are assembled with each other, and are accommodated in the holder accommodating chamber 31*c* of the connector housing 3, and therefore, the assembly work of the rear holder 32A and the electric wires 21 can be performed easily.

Second Embodiment

Figure 13:
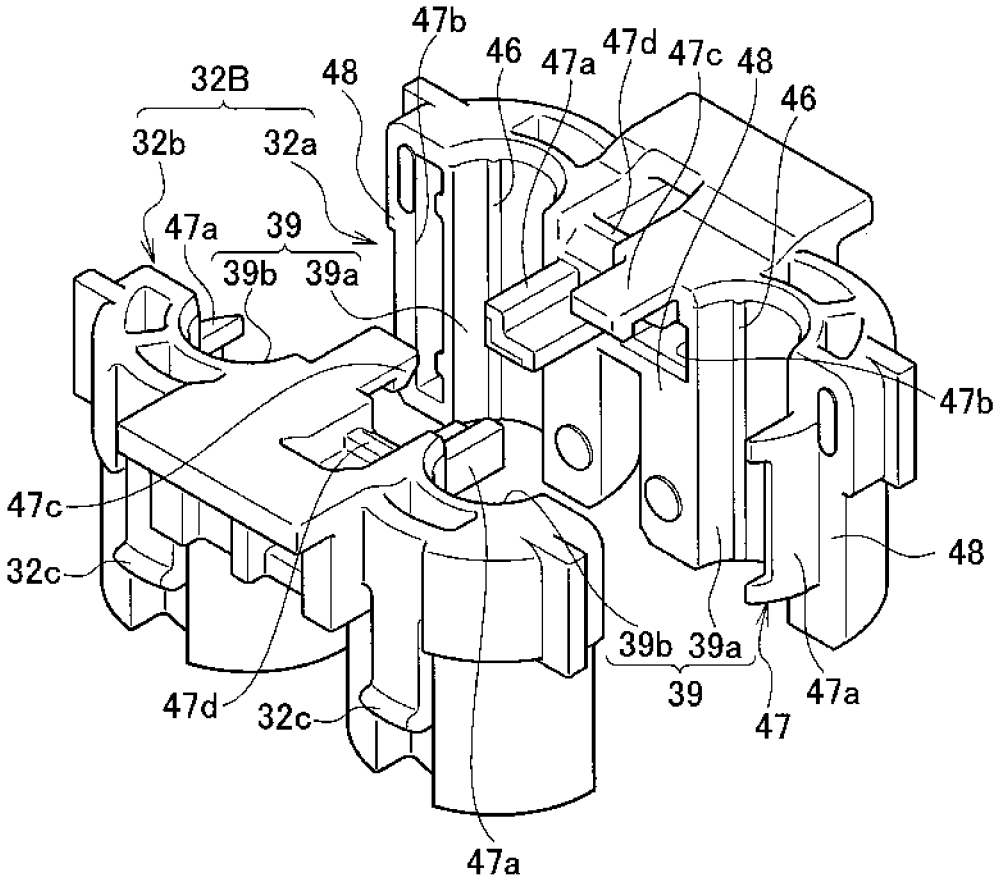
FIG. 13 illustrates the second embodiment according to the present invention, and is a perspective diagram before the rear holder is coupled.
Figure 14A:
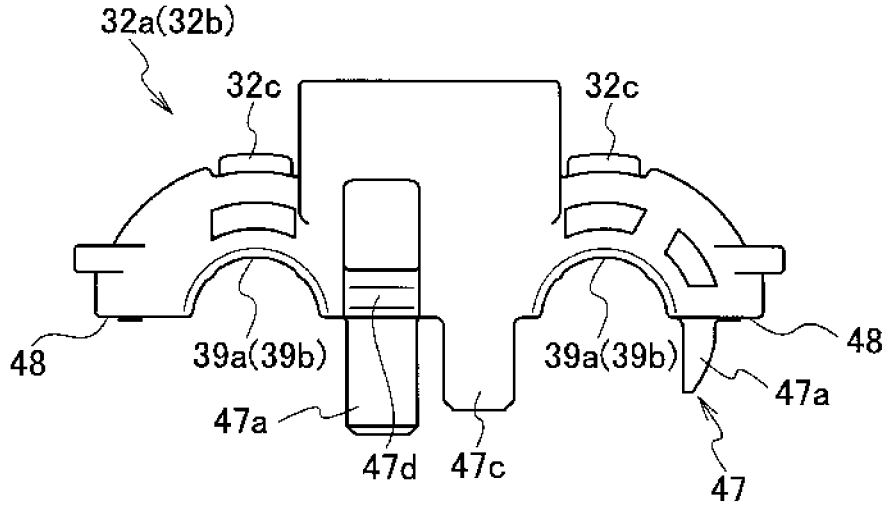
FIG. 14A illustrates the second embodiment according to the present invention, and is a top view illustrating a divided body of the rear holder.
Figure 14B:
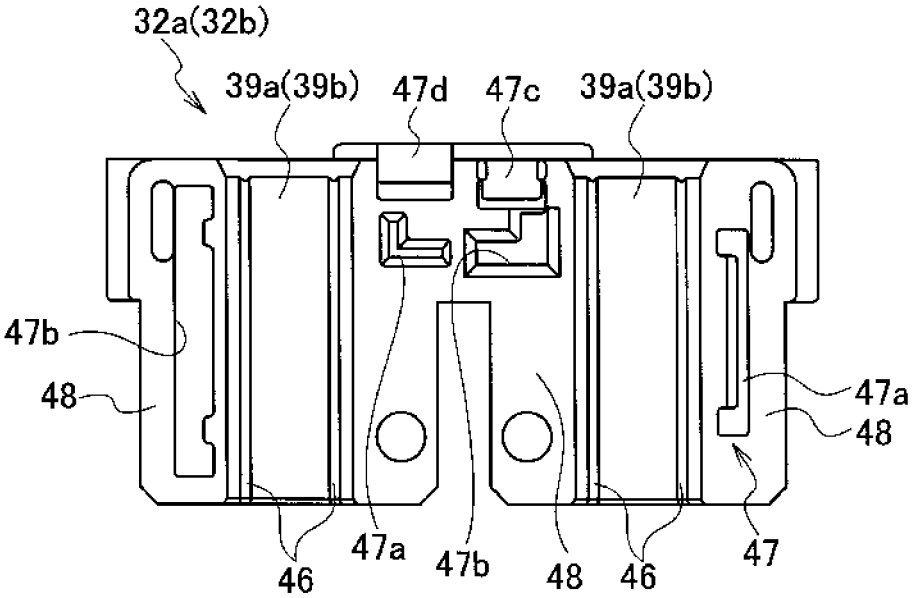
FIG. 14B illustrates the second embodiment according to the present invention, and is a front view illustrating the divided body of the rear holder.
Figure 14C:
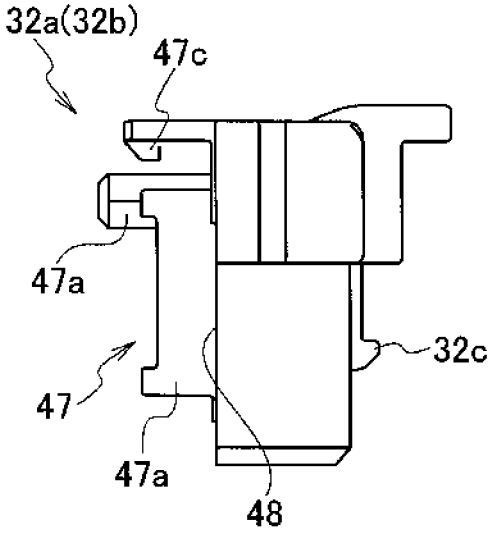
FIG. 14C illustrates the second embodiment according to the present invention, and is a side view illustrating the divided body of the rear holder.

FIG. 11A to FIG. 14C illustrate a second embodiment of the present invention. As shown in FIG. 12A, FIG. 12B and FIG. 13, a connector 1B of this second embodiment includes a terminal 2 and a connector housing 3 accommodating the terminal 2.

Like the first embodiment explained above, the connector housing 3 is provided with a terminal accommodating chamber (not shown) and an electric wire draw-out hole (not shown). A portion of the electric wire draw-out hole is formed as a holder accommodating chamber (not shown). The terminals 2 connected to electric wires 21 are accommodated in the terminal accommodating chambers. A rubber plug 33 attached to the electric wire 21 is accommodated in the electric wire draw-out hole. A rear holder 32B which is an electric wire holder attached to the electric wire 21 is accommodated in the holder accommodating chamber.

As shown in FIG. 13, FIG. 14A, FIG. 14B and FIG. 14C in details, like the first embodiment explained above, the rear holder 32B is configured of two divided bodies 32*a*, 32*b* assembled with each other. Each of the divided bodies 32*a*, 32*b* has an elastic arm locking portion 32*c*. When the rear holder 32B is inserted to an appropriate position of the holder accommodating chamber, each elastic arm locking portion 32*c* is locked with a locked portion (not shown) of the connector housing 3. In this case, the elastic arm locking portion 32*c* and a locked projection portion (not shown) are designed in view of the assembly tolerance.

Each of the two divided bodies 32*a*, 32*b* has a pair of semicircular electric wire grooves 39*a*, 39*b*. Multiple ribs 46 are provided on the inner periphery of each of the electric wire grooves 39*a*, 39*b*. Each of the divided bodies 32*a*, 32*b* is provided with a coupling portion 47 for coupling with each other. The coupling portion 47 includes mating walls 47*a* at multiple portions that protrude from an abutment surface 48 of each other of the divided bodies 32*a*, 32*b*, mating grooves 47*b* at multiple portions that are formed to be open at the opposite position of the other mating wall 47*a* and with which each mating wall 47*a* is mated, and a lock arm 47*c* that protrudes from the abutment surface 48 of each other, and a lock arm locking portion 47*d* with which the lock arm 47*c* is locked. The rear holder 32B is coupled such that the mating wall 47*a* of each other is mated with the mating groove 47*b*, and the lock arm 47*c* of each other is locked with the lock arm locking portion 47*d*. The mating walls 47*a* and the mating grooves 47*b* at multiple positions have the positioning function and the coupling strengthening function of the two divided bodies 32*a*, 32*b*.

In the rear holder 32B, each of the two electric wire insertion holes 39 is configured of a pair of electric wire grooves 39*a*, 39*b* while the two divided bodies 32*a*, 32*b* are assembled. Like the first embodiment explained above, an external diameter dimension D1 of the electric wire 21 is configured to be larger than an internal diameter dimension D2 of each electric wire insertion hole 39 (the external diameter dimension D1 of the electric wire 21>the internal diameter dimension D2 of each electric wire insertion hole 39). An internal diameter dimension D4 of the holder accommodating chamber of the connector housing 3 is configured to be larger than an external diameter dimension D3 of the rear holder 32B as a component alone (the external diameter dimension D3 of the rear holder 32B as the component alone<the internal diameter dimension D4 of the holder accommodating chamber of the connector housing 3).

An assembly step of the rear holder 32B to the electric wire 21 and an assembly step of the rubber plug 33, the rear holder 32B, and the like to the connector housing 3 are shown in FIG. 13, FIG. 14A, FIG. 14B and FIG. 14C. The assembly step of the rear holder 32B to the electric wire 21 and the assembly step of the rubber plug 33, the rear holder 32B, and the like to the connector housing 3 are the same as those of the first embodiment explained above, and the explanation thereabout is omitted.

With the connector 1B according to this second embodiment, because of the same reason as those of the first embodiment explained above, backlash between the electric wire 21 and the rear holder 32B is eliminated, and in addition, backlash between the connector housing 3 and the rear holder 32B is eliminated. Therefore, the rear holder 32B can shut off vibration from the electric wire 21. In addition, in each of the divided bodies 32*a*, 32*b*, multiple ribs 46 are provided on the inner periphery of each of the electric wire grooves 39*a*, 39*b*. The rib 46 digs into the electric wire 21, so that the fixing force between the electric wire 21 and the rear holder 32B is improved.

The two divided bodies 32*a*, 32*b* have the coupling portion 47 for coupling with each other. Therefore, the attachment performance of the rear holder 32B to the electric wire 21 is high, and furthermore, the two divided bodies 32*a*, 32*b* are rigidly coupled, and this reliably prevents the backlash between the electric wire 21 and the rear holder 32B and between the connector housing 3 and the rear holder 32B.

The coupling portion 47 has the mating walls 47*a* and the mating grooves 47*b* mating therewith at multiple portions. Therefore, two divided bodies 32*a*, 32*b* can maintain an appropriate coupling form even while the two divided bodies 32*a*, 32*b* receive a compression force, and this can reliably prevent backlash between the electric wire 21 and the rear holder 32B and between the connector housing 3 and the rear holder 32B.

Although the embodiment of the present invention has been described heretofore, the embodiment is merely exemplified for facilitating the understanding of the present invention, and the present invention is not limited to the embodiment. The technical scope of the present invention may include not only the specific technical matters disclosed in the above-described embodiment but also various modifications, changes, and alternative techniques easily derived from the above-described specific technical matters.

This application claims priority based on Japanese Patent Application No. 2013-130299 filed on Jun. 21, 2013, and the entire contents thereof are herein incorporated by reference.

INDUSTRIAL APPLICABILITY

According to the present invention, the electric wires are inserted into the electric wire insertion holes of the electric wire holder, and the electric wire holder is accommodated in the holder accommodating chamber of the connector housing, the external diameter dimension of the electric wire is more than the internal diameter dimension of the electric wire insertion hole of the electric wire holder, and the interference of the electric wire of the electric wire holder is exerted, and the external diameter dimension of the electric wire holder increases because of the elastic counterforce of this electric wire, and this eliminates the gap between the electric wire holder and the holder accommodating chamber of the connector housing, and the electric wire holder is pressed against the connector housing. Therefore, backlash between the electric wire and the electric wire holder is eliminated and in addition, backlash between the connector housing and the electric wire holder is eliminated. Therefore, the electric wire holder can cut off the vibration from the electric wire.

REFERENCE SIGNS LIST

1A, 1B Connector
2 Terminal
3 Connector Housing
21 Electric Wire
31*c* Holder Accommodating Chamber
32*a*, 32*b* Rear Holder (Electric Wire Holder)
32*a*, 32*b* Divided Body
39 Electric Wire Insertion Hole
39*a*, 39*b* Electric Wire Groove
47 Coupling Portion

The invention claimed is:

1. A connector comprising:

a connector housing provided with a holder accommodating chamber, and an electric wire holder including an electric wire insertion hole with a substantially constant internal diameter dimension and a substantially constant external diameter dimension, wherein the electric wire holder is configured to receive an electric wire into the electric wire insertion hole and to be accommodated within the holder accommodating chamber, wherein an external diameter dimension of the electric wire is configured to be larger than the internal diameter dimension of the electric wire insertion hole of the electric wire holder, and an internal diameter dimension of the holder accommodating chamber of the connector housing is configured to be less than an external diameter dimension of the electric wire holder in a state where the electric wire is accommodated in the electric wire insertion hole, and wherein the electric wire insertion hole and the electric wire are shaped such that no gaps are formed between the electric wire insertion hole and the electric wise.

2. The connector according to claim 1, wherein the electric wire holder includes two divided bodies each provided with an electric wire groove, and the electric wire insertion hole is formed by the two electric wire grooves.

3. The connector according to claim 2, wherein the two divided bodies have a coupling portion for coupling with each other.

4. The connector according to claim 2, wherein each of the electric wire grooves includes at least one protruding rib extending along an axial direction of the electric wire holder.

5. The connector according to claim 2, wherein each divided body includes an elastic arm locking portion.

* * * * *